US005239713A

United States Patent [19]

Toivio et al.

[11] Patent Number: 5,239,713

[45] Date of Patent: Aug. 31, 1993

[54] HOSPITAL BED

[75] Inventors: Ilkka Toivio; Terttu Toivio, both of Lahti, Finland

[73] Assignee: Ahlstrom Consumer Products, Ltd., Kauttua, Finland

[21] Appl. No.: 852,140

[22] PCT Filed: Oct. 26, 1990

[86] PCT No.: PCT/FI90/00256

§ 371 Date: May 18, 1992

§ 102(e) Date: May 18, 1992

[87] PCT Pub. No.: WO91/06273

PCT Pub. Date: May 16, 1991

[30] Foreign Application Priority Data

Oct. 27, 1989 [FI] Finland ..... 895127

[51] Int. Cl.[5] ..... A61G 7/08

[52] U.S. Cl. ..... 5/81.1; 5/83.1; 5/84.1; 5/86.1; 5/89.1

[58] Field of Search ..... 5/81.1, 83.1, 84.1, 5/85.1, 86.1, 600, 620, 89.1; 248/129

[56] References Cited

U.S. PATENT DOCUMENTS

| | | | |
|---|---|---|---|
| 274,527 | 3/1883 | Stelle et al. | 5/87.1 |
| 982,289 | 1/1911 | Miller | 5/84.1 |
| 1,876,832 | 9/1932 | Bancroft | 5/89.1 |
| 2,792,945 | 5/1957 | Brenny | 5/81.1 |
| 3,627,250 | 12/1971 | Pegrum | 5/81.1 |
| 3,631,546 | 1/1972 | Eliasson | 5/81.1 |
| 3,846,853 | 11/1974 | Jacobsson | 5/81.1 |
| 3,877,421 | 4/1975 | Brown | 5/81.1 |
| 4,644,595 | 2/1984 | Daniel | 5/83.1 |
| 5,005,233 | 4/1991 | Toivio et al. | 5/83.1 |

*Primary Examiner*—Peter M. Cuomo
*Assistant Examiner*—Michael Milano
*Attorney, Agent, or Firm*—Cohen, Pontani, Lieberman, Pavane

[57] ABSTRACT

The present inventions relates generally to a hospital bed which is secured to a vertical wall structure and which supports a patient. The apparatus includes a support frame, a transfer underlay, means for suspending the transfer underlay and means for adjusting the support frame. Specifically, the support frame has both a vertically and horizontally extending arm portions. The means for adjusting the support frame is connected to the vertical extending arm portion and to the vertical wall structure for lifting and lowering the support frame as well as for rotating the support frame about the axis of the vertically extending arm portion. The means for suspending the transfer underlay suspends the transfer underlay from underneath the horizontally extending arm portion.

22 Claims, 5 Drawing Sheets

HOSPITAL BED

BACKGROUND OF THE INVENTION

The present invention relates to a bed, particularly to a patient bed.

The beds known in the prior art, particularly patient or hospital beds, comprise an underlay, frame and legs which are generally provided with wheels. On top of the underlay there is located a mattress on which the patient rests.

There are patient groups such as chronically non-ambulant old people, who need hospital treatment but are fairly little moved within the nursing facilities. For these patient groups the conventional patient beds are problematic. Moving the patients away from the bed and back is cumbersome. In connection with basic nursing, the repeated lifting of non-ambulant patients is necessary.

Another problem is that generally at least two nurses are needed for carrying out basic nursing measures, because one nurse should not do the shifting or lifting of the patient alone. Particularly the care of chronic patients in conventional beds requires a lot of personnel. Continuous lifting and shifting of the patients cause spinal symptoms and defects to the nurses.

SUMMARY OF THE INVENTION

The object of the present invention is to eliminate the above mentioned drawbacks.

According to the invention, the bed comprises an underlay for the patient; a support frame, provided with at least one support member, which is arranged above the underlay; and suspension means such as straps, whereby the underlay is suspended from the support member.

Thus the essential element of the support frame of the bed of the invention is the support member, the number whereof is advantageously one or two. The support member is arranged in the patient room or other suitable space at a suitable height, such as 1.5 . . . 2.5 m, and is attached to the structures of the premises by means of other elements of the support frame, such as one or more wall or roof fastener and/or vertical support. The same support member can also be employed as the suspension support of several, for instance two, separate underlays.

In a preferred embodiment of the bed, the underlay is attached with suspension means to the support member, so that the support points are located at a distance from each other, and that at least one of the support points is located outside the line drawn via two or more support points.

This fastening by three or more points secures that the underlay is suspended in a stabile fashion to the support member of the support frame. Thus the underlay does not easily swing from side to side, and in case it does swing during the nursing measures, the winging motion is easily attenuated.

In a preferred embodiment of the bed, the support member is formed of an essentially horizontal elongate bar, the first end whereof is free, and in the lengthwise direction whereof the underlay is suspended.

The length of the support member is advantageously designed so that one underlay can be suitably suspended thereto, and that it is easily fastened to the structures of the premises.

In a preferred embodiment of the bed, the support frame comprises at least one essentially vertical support member, whereto the horizontal support member is connected.

By means of the vertical support member, the fastening of the support frame to the wall structures of the premises can be carried out for instance at the height of 0.5 . . . 1.0 m from the floor, and if necessary supported against the floor.

In a preferred embodiment of the bed, the support frame comprises a leg member, which is attached to the vertical support member and is arranged to extend to underneath the underlay.

Thus the horizontal support member, the vertical support member and the leg member together form, when seen from the side, a U-shaped structure, where the major part of the patient's weight against the horizontal support member is directed towards the floor via the leg member. This means that the fastening of the support frame to the structures of the premises can be realized with equipment with a fairly light structure.

In a preferred embodiment of the bed, the leg member is formed of an elongate bar, which is on the same vertical level as the horizontal support member. Such a structure makes the support frame remarkably lighter, at the same time maintaining a good solid strength and support capacity.

In a preferred embodiment of the bed, the support frame is detachably fastened to the structures of the premises.

In a preferred embodiment of the bed, the support frame is detachably fastened to the structures of the premises, and in similar fashion it can be fastened to a transport couch, particularly to the transport couch of the patient.

In a preferred embodiment of the bed, the structures of the premises are provided with a first socket member, and the transport couch is provided with a second socket member, and the bed is provided with fastening means which can be connected both to the first and the second socket member.

When the patient is being moved from one room to another on the transport couch, the support frame of the bed can be coupled to the transport couch and be transported along with the patient. Then the support frame of the bed can again be fastened to a suitable, specially reserved spot. The patient can be left lying on the couch to wait for treatment. Now the transport couch can again be used for moving other patients.

In a preferred embodiment of the bed, the support frame is attached at its vertical support member, essentially turnably on the horizontal level, to the fastening means.

In a preferred embodiment of the bed, the bed includes a hauling apparatus, whereby the underlay can be raised and lowered with respect to the floor level.

The steps of horizontal turning and vertical adjusting of the underlay can be used in various nursing measures carried out for the patient.

In a preferred embodiment of the bed, the bed includes a hauling apparatus which is connected to the essentially vertical support member provided in the support frame, by means of which hauling apparatus at least the horizontal support member and the underlay suspended therefrom can be raised or lowered.

In a preferred embodiment of the bed, the hauling apparatus comprises at least one fluid cylinder. Generally speaking the transmission equipment, particularly the hauling apparatus, can be formed of manually operated power means such as a bottle jack, or of electric, pneumatic or hydraulic power actuators and power transmission means connected thereto.

In a preferred embodiment of the bed, there is provided at least one crossbar in connection with the support member, the arms of the crossbar being at an angle with respect to the horizontal support member and connected to the underlay by means of straps or other such suspending means.

In a preferred embodiment of the bed, the crossbar is fastened to the horizontal support member by means of fastening members, so that the crossbar can be moved along the horizontal support member and locked at a desired point. Thus the crossbar can be adjusted to an advantageous spot so that the underlay and hence the patient are firmly and securely in the support of the support member.

Generally the number of these crossbars is one or two. They are installed in the support member at the patient's shoulders and, in case there are two, at the patient's knees, supposing that the patient rests on the underlay. The arms of the crossbars are either stationary, folding or adjustable with respect to the horizontal support member. They can also be constructed in a telescopic fashion of nested parts.

In a preferred embodiment of the bed, there is at least one additional member provided at the free end of the support member, whereby the support member can be lengthened. It can be fitted, for instance, mostly within the support member, and pulled out therefrom to form a continuation to the support member. Thus the support member can be lengthened when necessary.

In a preferred embodiment of the bed, the straps or other such suspension means are arranged on rollers. The rollers are provided in connection with the horizontal support member and/or crossbar, and they can be provided with for example mechanical or electric rotation means in order to facilitate the reeling of the straps. When the bed is not in use, the straps are in rest position wound on the rollers, from which rollers the straps are again easily pulled down and fastened to the underlay.

In a preferred embodiment of the bed, the rollers are charged with springs so that the straps are in the rest position, wound on the rollers, when the bed is not in use, from which rollers the straps can be pulled out and fastened to the underlay when the bed is being used. The employed spring-charged rollers can be any of the known types, such as the strap-and-roller types used in connection with car safety belts.

In a preferred embodiment of the bed, the underlay comprises a bottom part which is made of some flexible material, and support rails, which are fitted at least on the long sides of the underlay. Advantageously the support rails are fitted on all sides of the underlay and interconnected so that they form a frame for the underlay.

The support rails are advantageously fastened to the underlay in a detachable fashion. While using the bed of the present invention, the straps are easily fastened at four points to the support rails located on the long sides of the underlay, in the vicinity of the ends of the underlay. In practice such an underlay is a cot-like bed where the patient gets a comfortable rest.

In a preferred embodiment of the bed the underlay is formed of net.

In a preferred embodiment of the bed the underlay is made of some waterproof material.

In a preferred embodiment of the bed the bottom of the underlay is made of two layers: a first layer, which is made of some material well permeable to air and water, such as net or some resembling material; and of a second layer, which is made of some waterproof material such as plastic foil; and which second layer can be detachably fastened under the first layer.

Normally the patient lies on the first layer of the underlay. The second layer is used when the patient is washed, in which case it is produced and fastened under the first layer. The first layer is advantageously made of some water-repellent material, so that it does not absorb water in connection with the washing.

In a preferred embodiment of the bed, the second layer of the underlay is arranged to be rolled on a roller along the long side of the underlay, wherefrom it can be drawn to under the first layer.

In a preferred embodiment of the bed that layer of the underlay which is made of waterproof material is provided with an aperture whereto a discharge hose can be connected. This underlay can be used while washing the patient, in which case the washing water is conducted, via the hose, to a sewer or other receptable where water can be collected. When the washing of the patient is arranged thus, it can be carried out conveniently in bed.

In a preferred embodiment of the bed, the underlay is provided with an aperture for a bedpan. This aperture is advantageously provided with a hatch which is made of the same material as the underlay. This hatch is opened when necessary. Thus it is not necessary to lift the patient up from the underlay, but the bedpan is arranged underneath the underlay, at the aperture provided therein.

In a preferred embodiment of the bed, the underlay includes an insulating layer, which is detachably fastened underneath the underlay. By means of this insulating layer the patient keeps warm and does not get cold underneath. Generally there is not used a mattress and usually not even a sheet in between the patient and the underlay.

In a preferred embodiment of the bed, in connection with the support frame there are arranged means for measuring the weight of the patient. The weighing is carried out easily by means of the measuring sensor or device installed in connection with the bed.

An advantage of the invention is that the bed is simple and reduced in structure.

Another advantage of the invention is that the bed is particularly suited for non-ambulant chronic patients.

Yet another advantage of the invention is that the underlay connected to the bed can be modified in many different ways according to the needs.

Further, owing to the invention it is not necessary to lift the patient out of bed when he must be taken for instance to separate nursing premises, but the patient can be moved with suitable transport equipment while he is lying in his own bed.

Yet another advantage of the invention is that the patient on his underlay can be suspended, after being transported from one room to another, to the support of the support frame arranged in the new premises.

Yet another advantage of the invention is that in a preferred embodiment of the invention, the support frame can be moved, on a suitable shifting platform, as a while for instance from the dormitory to a nursing room.

Yet another advantage of the invention is that the height of the underlay from the floor can be adjusted.

Another further advantage of the invention is that the support member and at the same time the underlay can be turned on the horizontal level.

Furthermore, the maintenance, such as cleaning, of the premises becomes easier owing to the present invention.

Moreover, owing to the invention and particularly to the versatility of the underlay, the nursing measures such as washing the patient and adjusting the bedpan, become easier.

Moreover, owing to the invention the patient rests on an underlay which is easily air-conditioned.

Yet another advantage of the invention is that the underlay conforms flexibly to the movements of the patient, so that the formation of bedsores is prevented or at least reduced.

Further, owing to the invention less personnel is required for taking care of the patients.

Yet another advantage of the invention is that it remarkably facilitates the work of the nursing personnel, and increases their safety at work.

Moreover, owing to the invention the transport of the patients can be carried out irrespective of the conditions, for instance in narrow, crowded spaces.

Yet another advantage of the invention is that in connection with the bed of the present invention, there can be used many different types of underlays, which are designed for different uses.

Yet another advantage of the invention is that the structures of the bed, particularly the horizontal support member above it, can be utilized in the nursing or auxiliary measures for instance for suspending various devices such as rehabilitation and training devices. This is possible because the support member extending above the bed does not necessarily include any obstacles for the instalment of auxiliary devices.

Yet another advantage of the invention is that the bed can easily be provided with means for weighing the patient. Controlling the patient's weight is important particularly with certain patient groups, such as non-ambulant old people.

BRIEF DESCRIPTION OF THE DRAWINGS

In the following the invention and its advantages are explained in more detail with reference to the appended drawings, where.

DESCRIPTION OF THE PREFERRED EMBODIMENT

The bed of the present invention comprises the underlay 1, on top of which the patient is arranged to lie; a support frame 2, which comprises an essentially horizontal support member 2*a*, and an essentially vertical support member 2*b*, which horizontal support member 2*a* is arranged above the underlay; and suspension means 3, such as straps, whereby the underlay 1 is suspended from the horizontal support member 2*a*.

Figure 1:
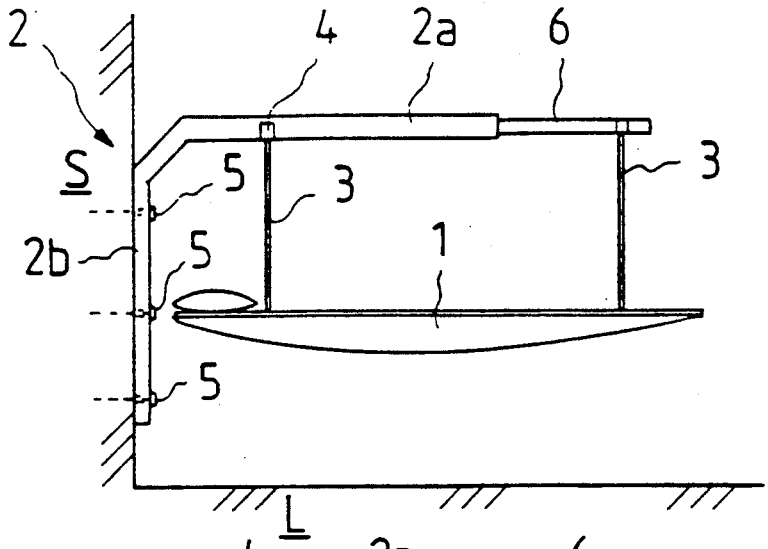
FIG. 1 illustrates a bed as seen from the side.

The support frame 2 is attached to the structures of the premises, for instance to the wall 5, as is illustrated in FIG. 1. In this case the support frame 2 is fastened to the wall with fastening means, such as studs 5, at the vertical support member 2*b*.

The support member 2*a* is formed of an at least roughly horizontal, elongate bar, the first end whereof is free and the second end whereof is connected to the vertical support member 2*b*, which also is formed of an elongate bar. The support members 2*a* and 2*b* can be interconnected in an arched or angular fashion.

Figure 2:
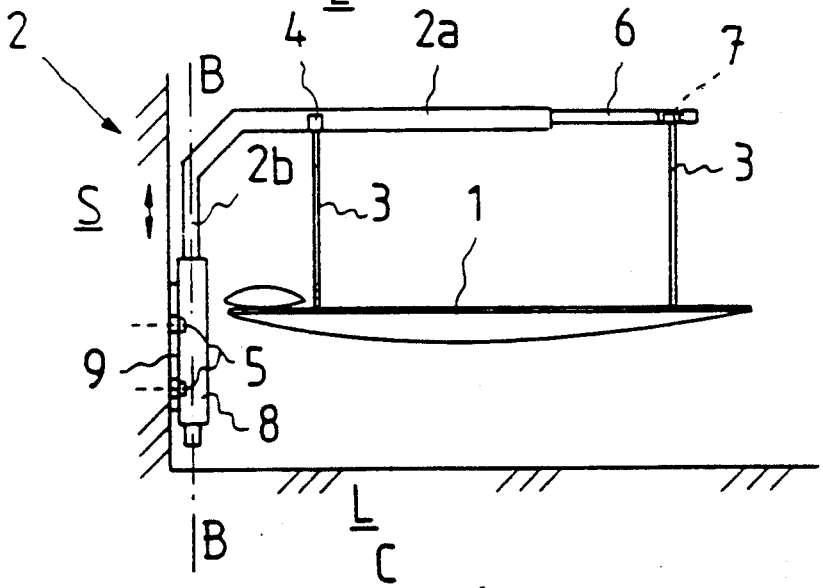
FIG. 2 illustrates another bed as seen from the side.
Figure 3:
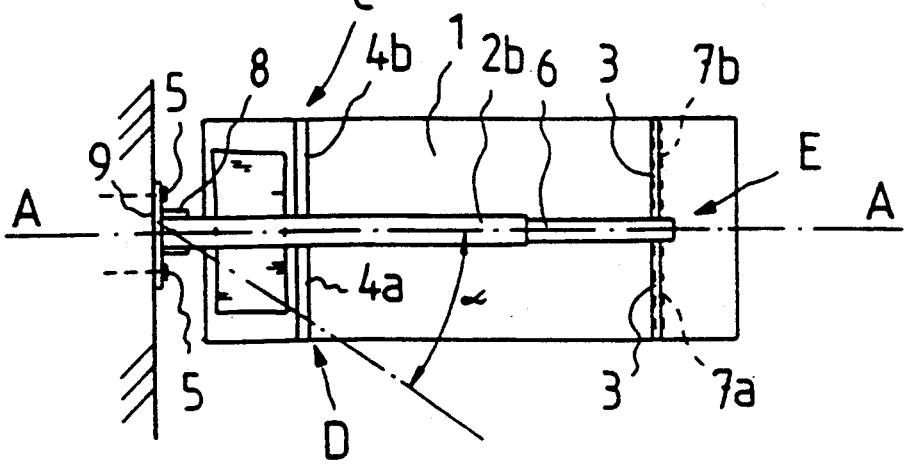
FIG. 3 illustrates the bed of FIG. 2 as seen from the top.

In the embodiments of FIGS. 1, 2 and 3, the horizontal support member 2*a* of the support frame 2 is provided with a continuation 6. This is fitted at least partly inside the support member 2*a*, and can be pulled out to form a continuation for the support member 2*a* when the need arises to lengthen the support member 2*a*. Thus the distance of the suspending means 3 from each other can be lengthened, so that there can be used a long underlay 1, or shortened, so that a short underlay 1 is used, depending on the length of the patient.

In connection with the support member 2*a* there is provided a crossbar 4. The arms 4*a*, 4*b* of the crossbar 4 are placed at an angle, advantageously 90°, with respect to the support member 2*a*.

The suspension means 3, which in the following are generally called straps, can be formed of members of a given length, which members are flexible and bendable but maintain their length.

The underlay 1 is fastened, by means of the straps 3, to the support member 2*a* of the support frame 2, above the underlay 1, at least when the bed is being used. The support points C, D, E of the straps 3 in the support frame 2, i.e. in the support member 2*a* and the connected crossbar 4 and continuation 6, are located at intervals from each other. At least one for instance C, of the support points is located outside the line drawn via the other support points D, E. Thus the underlay 1 is supported against the support frame at three points C, D, E falling on the apices of a triangle, preferably an equilateral triangle. In that case the patient P lies in the bed in a stabile fashion, in the support of the support frame 2.

The said fastening points C, D are in FIG. 3 located at the ends of the arms 4*a*, 4*b* of the crossbar 4, wherefrom the arms 4*a*, 4*b* are connected, by means of the straps 3, to the sides of the underlay 1, on both sides of the top part of the patient's body. In FIG. 3 the third support point E is located at the end of the auxiliary member 6, where the straps 3 are fastened at their other end, and further connected to the sides of the underlay 1, on both sides of the patient's feet.

The free end of the support member 2a, or the continuation 6 connected thereto, can also be provided with another crossbar 7 which in structure corresponds to the crossbar 4. This second crossbar is illustrated with dotted lines in FIGS. 1, 2 and 3. Thus for instance the foot of the patient's bed can be lifted in similar fashion as the head.

It is, however, maintained that in most cases the attaching of the fastening members directly to the support member 2a (or continuation 6) is a fully satisfactory measure, and the patient can rest in a perfectly safe and stabile fashion in an underlay thus suspended.

In the embodiments of FIGS. 2 and 3, the bed comprises a hauling apparatus 8. It is connected to the vertical support member 2b. Thereby the vertical support member 2b can be raised and lowered, so that simultaneously the horizontal support member 2a and the underlay 3 suspended thereto rise or descend.

The hauling apparatus 8 can be realized with a gear rack and gear wheel combination, where the gear rack is arranged in connection with the support member 2b. The gear wheel can be rotated with a suitable power means such as a hand crank or an electric motor. Alternatively the hauling apparatus can also be realized with a fluid cylinder, whereto the fluid is fed by means of a hand pump or suitable actuator, such as a pump operated with an electric motor.

The hauling apparatus 8 is connected to the fastening means 9, such as a flange, whereby the support frame 2 of the bed is fastened to the wall S of the premises by means of studs 5 or other corresponding fastening means.

The support frame 2 of the bed is attached, at the vertical support member 2b and turnably around the axis B—B, to the hauling apparatus 8. The support frame 2, particularly the horizontal support member 2a, can thus be turned at a predetermined angle $\alpha$ from the basic position, which is perpendicular to the wall structure S, to either side thereof. The support frame 2 can be locked in a desired position.

Figure 4:
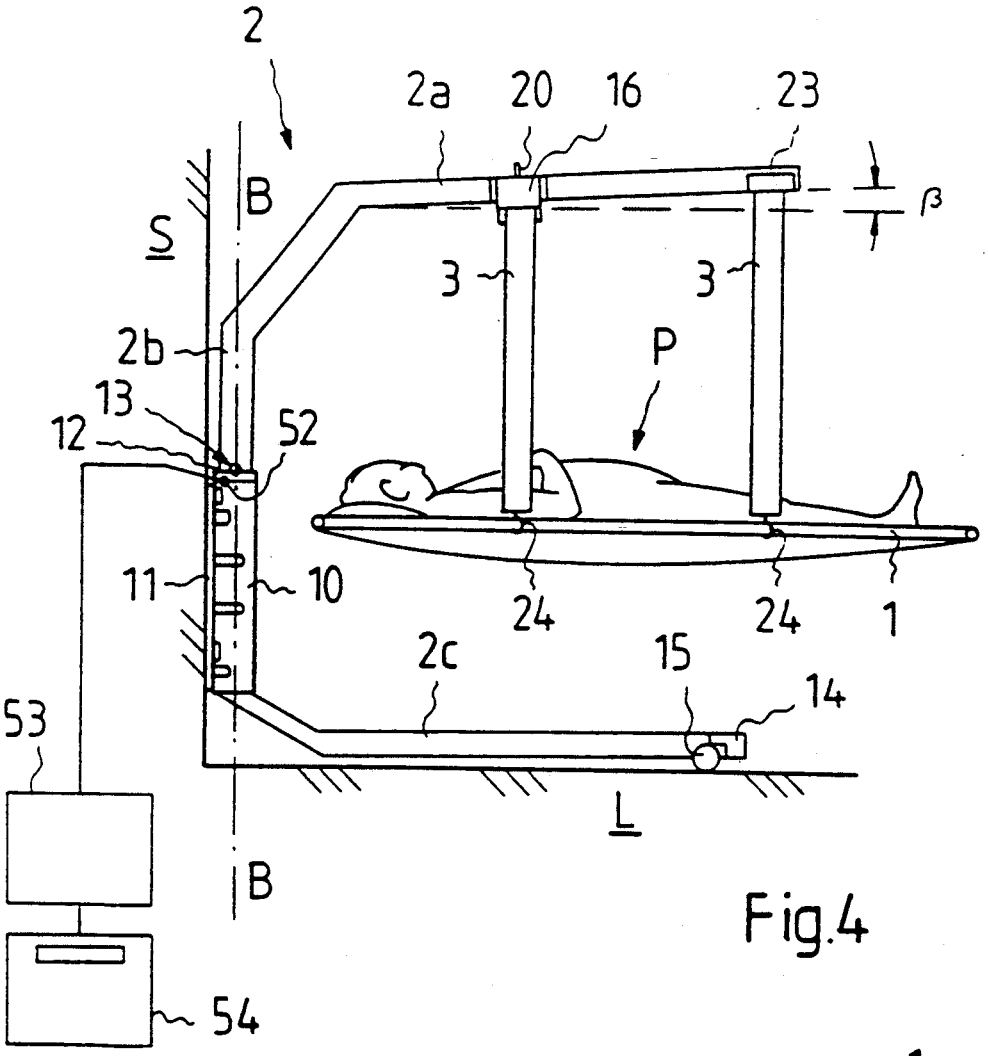
FIG. 4 illustrates a third bed as seen from the side.
Figure 5:
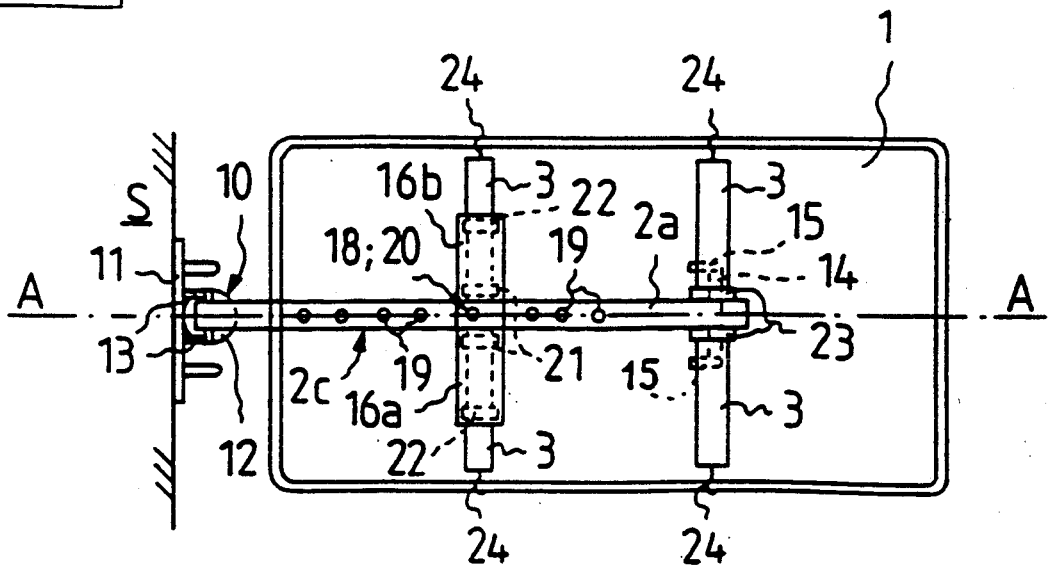
FIG. 5 illustrates the bed of FIG. 4 as seen from the top.

In FIGS. 4 and 5, there is illustrated a third bed according to the invention. The support member 2a of the support frame 2 is adjusted at a small angle $\beta$ (for instance 5°) with respect to the horizontal plane, and it is diagonally connected to the vertical support member 2b. The vertical support member 2a is fitted in a tubular member 10, which is attached to the wall S by means of fastening members 11.

The vertical support member 2b of the support frame 2 is fastened to the tubular member 10 by means of an annular support member such as a sliding bearing. The sliding bearing 12 rests above the top part of the tubular member 10 either freely or suitably attached thereto. The vertical support member 2b is provided with a bracket, such as a pin 13 or an annular flange. This bracket 13 is suitably fastened to the vertical support member 2b, and thereon the support frame 2 rests on top of the sliding bearing 12 and the tubular member 10.

The horizontal support member 2a of the support frame 2 is advantageously locked in place, so that it cannot be turned in the direction of the axis B—B of the vertical support member 2b. This can be realized with a mechanical locking member that locks the tubular member 10 and the support member 2b suitably together. When necessary, the locking member can be opened and the horizontal support member 2a together with the connected underlay 1 can be turned.

The support frame 2 of the bed comprises, in addition to the horizontal and vertical support members 2a, 2b, a leg support 2c. The leg support 2c is connected to the vertical support member 2b, and it is directed to underneath the underlay 1 on the same vertical level as the horizontal support member 2a. In the embodiments of FIGS. 4 and 5, the leg member 2c is attached to the end of the vertical support member 2b that reaches through the tubular member 10. Advantageously the leg member 2c is an elongate bar, the free end whereof, located underneath the underlay 1, is supported against the floor L.

At its free end the leg member 2c can be provided with one or several wheels, rollers or the like members. In the embodiments of FIGS. 4 and 5, the free end of the leg member 2c is supported with a cross-bar 14, which is provided with small wheels or rollers 15 at intervals from each other.

Figure 6:
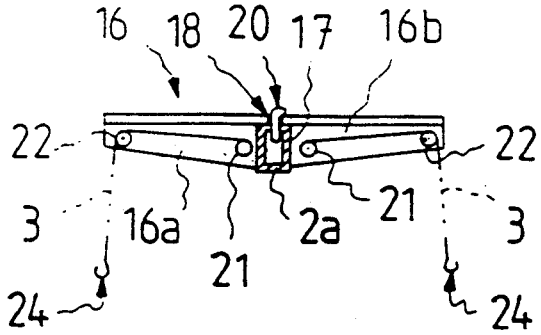
FIG. 6 illustrates the crossbar connected to the horizontal support member of the bed.

In connection with the roughly horizontal support member 2a of the support frame 2, there is provided a crossbar 16 in FIGS. 4, 5 and 6. The crossbar 16 is attached to the support member 2a by means of fastening members so that it can be moved along the support member 2a and locked in place at a desired point.

In this case the fastening members include an aperture 17 or a similar member of the crossbar 16, wherethrough the support member 2a is arranged to pass, a hole 18 in the crossbar and a number of apertures, such as holes 19, which are arranged at intervals from each other in connection with the horizontal support member 2a, and a pin 20 or similar locking member. The pin 20 is inserted in the holes 18, 19, in which case the crossbar is locked in place. The crossbar 16 is positioned, on a suitable spot in the horizontal support member 2a, so that the underlay 1 complete with the patient is safely suspended from the support frame 2.

The straps 3 are arranged, according to FIG. 6, on rollers 21. These rollers 21 are placed in the crossbar 16, in the vicinity of the fastening point of the support member 2a, parallel to the support member and at the same time to the lengthwise axis A—A of the underlay 1. At the ends 16a, 16b of the arms of the crossbar 16, there are installed folding wheels 22, wherethrough the straps 3 are arranged to pass, as is seen from FIG. 6.

In the vicinity of the free end of the support member 2a of the support frame 2, there is arranged a second set of rollers 23 on both sides of the support member 2a, so that the axes thereof are parallel to the lengthwise axis A—A of the support member. The second set of rollers 23 is provided with straps 3 in similar fashion as the first set 21.

The rollers 21, 23 are advantageously charged with springs so that the straps are in their rest position wound on the rollers 21, 23. From the rollers 21, 23 the straps can be pulled down from the crossbar 16 or from the support member 2a, and fastened to the underlay 1 by means of clasps 24 or other such fastening means.

The straps 3 arranged on the rollers 21, 23 are of defined lengths. The lengths of the straps are such that the underlay 1 complete with the patient P rests at a suitable height from the floor, for instance 60 . . . 70 cm. Alternatively the rollers 21, 23 can be provided with locking members in order to prevent winding or lengthening of the strap after the desired height of the underlay has been set.

The patient is placed in the bed of the present invention as follows. A transport couch is used as an aid in the process. The underlay 1 is arranged on top of the transport couch for the patient, whereafter the patient is lifted on top of the underlay 1 and the transport couch. The patient is transported on the couch to beside the bed of the invention, to underneath the horizontal support member 2*a* of the support frame 2. Thereafter the straps 3 are pulled down from the rollers 21, 23, and fastened at the sides of the underlay 1, in the vicinity of both ends thereof, on the left and right sides of the patient. Thereafter the transport couch is lowered, until the underlay 1 complete with the patient P rests freely from the straps 3 in the support of the support frame 2. Now the transport couch can be removed.

If the bed of the invention is provided with a hauling apparatus 8 as in FIG. 2 and 3, the height of the transport couch does not necessarily have to be adjustable. In that case the hauling apparatus 8 is utilized while shifting the patient onto the underlay, to be supported by the support member 2*1* by means of the straps 3.

Figure 7:
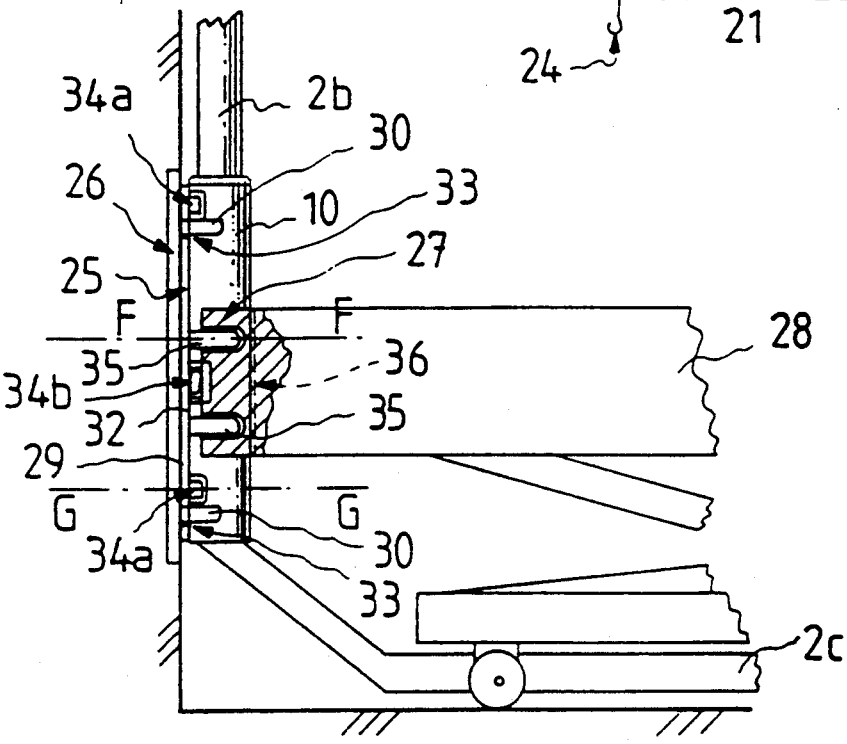
FIG. 7 illustrates the joining of the support frame of the bed to the transport couch.
Figure 8A:
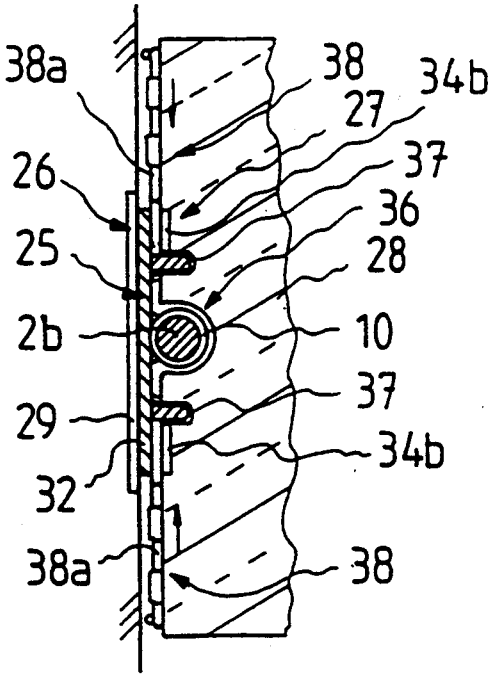
FIGS. 8A and 8B illustrate details from FIG. 7, seen along the sections F—F and G—G.
Figure 8B:
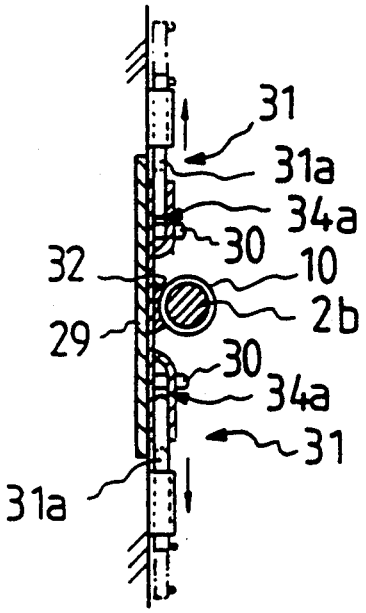

The support frame 2 of the bed of the invention can be detachably fastened to the structures of the premises, for instance to the wall. On the other hand, the support frame can be detachably fastened to a suitable transport couch, for example the transport couch of the patient. One such arrangement is illustrated in FIGS. 7 and 8.

The support frame 2 is provided with fastening means 25 and the structures of the premises, for instance the wall S of the patient room, is provided with a first socket member 26 and the transport couch 28 with a second socket member 27. The first socket member 26 is formed of a plate-like housing 29 provided with a number of brackets such as pins 30, and the first set of locking members 31. These locking members include at least two lock bolts 31*a* or similar members, which are fastened so that they can be moved in a direction parallel to the surface of the housing 29.

The vertical support member 2*b* of the support frame 2 is provided with fastening means 25 including a fastening flange 32 with holes 33 for the pins 30 of the first socket member 26, and a first set of nests 34*a* for the lock bolts 31*a* or corresponding members of the locking members 31 of the first socket member. The fastening members 25 also include a second set of nests 34*b* for the second set of locking members 38. The fastening flange 32 also is provided with a second set of brackets, such as pins 35.

The second socket member 27 of the transport couch 28 is provided with a recess 36 for the vertical support member 2*b* of the support frame 2 and for the tubular member 10, with apertures 37 whereto the second set of pins 35 of the fastening members 25 can be fitted, and further a second set of locking members 38, which are advantageously similar as the first set of locking members 31. The lock bolts 38*a* of the second set of locking members 38 can be locked to the second set of nests 34*b* provided in connection with the fastening members 25.

The locking members 31, 38 and nests 34*a*, 34*b* provided in the fastening members 25 and socket members 26, 27 together form two sets of fast coupling means, whereby the support frame 2 can be easily attached to the wall structure and detached therefrom, and respectively the support frame 2 can be easily attached to the transport couch 28 and detached therefrom.

The coupling of the support frame 2 on one hand to the wall S of the premises, and on the other hand to the transport couch 28, takes place as follows. In FIG. 7 the support frame 2 is attached to the wall S. The holes 33 of the fastening flange 32 of the fastening members 25 are fitted to the first set of pins 30 of the firs socket member, and the bolts 31*a* of the locking members 31 of the socket member are inserted to the nests 34*a* of the fastening flange 32. When the support frame 2 is desired to be attached to the transport couch 28, it is moved so that first comes the end provided with the recess 36, to against the vertical support member 26 of the support frame 2 and the tubular member 10, so that the pins 35 provided in the fastening flange 32 match the apertures 37 of the transport couch 28. Thereafter the bolts 38*a* of the locking members 38 of the transport couch 28 are shifted and locked in the nests 34*b* of the fastening flange 32, so that the transport couch 28 is coupled to the fastening members 25. Thereafter the bolts 31*a* of the locking members 31 of the first socket member 26 are released and pulled out of the nests 34*a* of the fastening flange 32, so that the fastening flange 32 can be drawn, together with the transport couch 28, apart from the pins 30 of the socket member 26. Now the support frame 2 is attached to the end of the transport couch 28 with fastening members. In a corresponding fashion but opposite order, the support frame 2 together with fastening members 25 can be reattached either to the same socket member 26 or to a similar socket member 26 in other premises.

Figure 9:
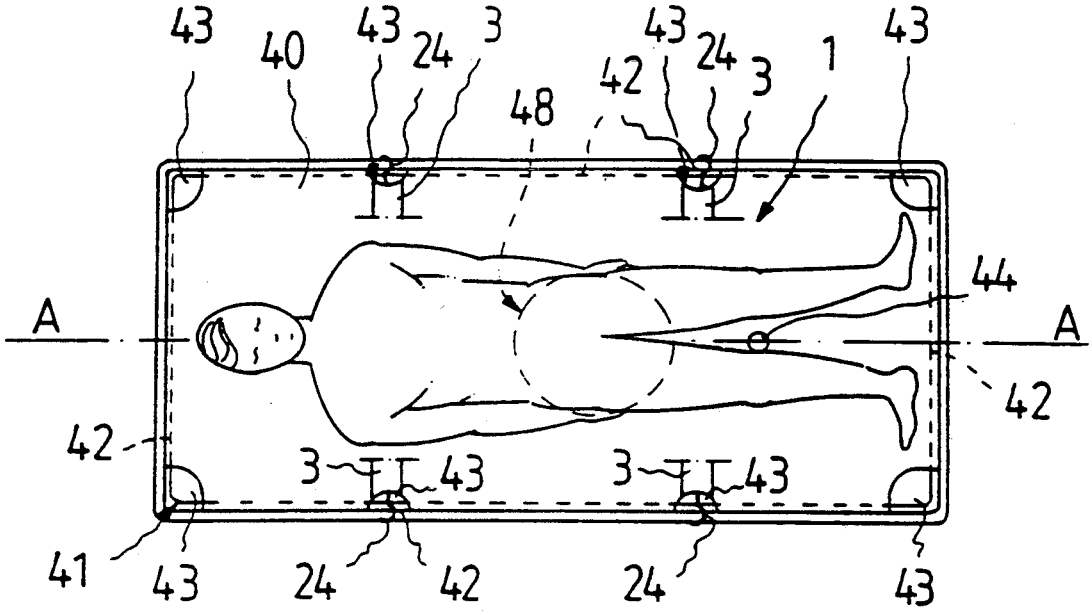
FIG. 9 illustrates an underlay seen from the top.
Figure 10:
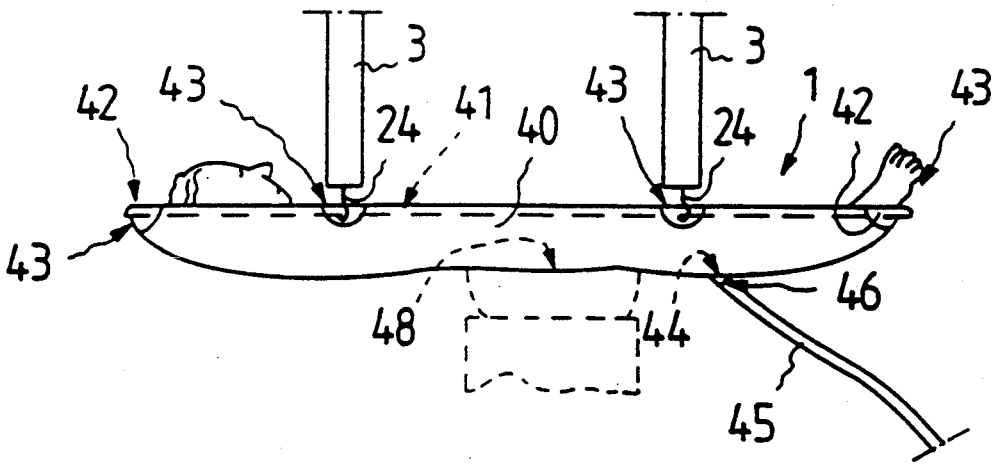
FIG. 10 illustrates the underlay of FIG. 9, seen from the side.

FIGS. 9 and 10 show a schematical illustration of an underlay 1. In width and length this underlay corresponds at least roughly to a normal bed. The underlay 1 comprises the bed bottom 40 and the frame 41. The bottom 40 is formed of some flexible, advantageously thin material, which, however, carries even a heavy patient well. The frame 41 is formed of support rails 42, which are fitted on all sides of the bottom 40. Along the sides of the bottom 40, there are formed tubular passages, where the support rails 42 are inserted and then connected to each other. In order to fasten the clasps 24 of the straps 3, there are provided apertures 43 on the sides of the bottom 40. Now the clasps 24 are easily inserted through the apertures 43 and fastened to the support rails 42.

Figure 11:
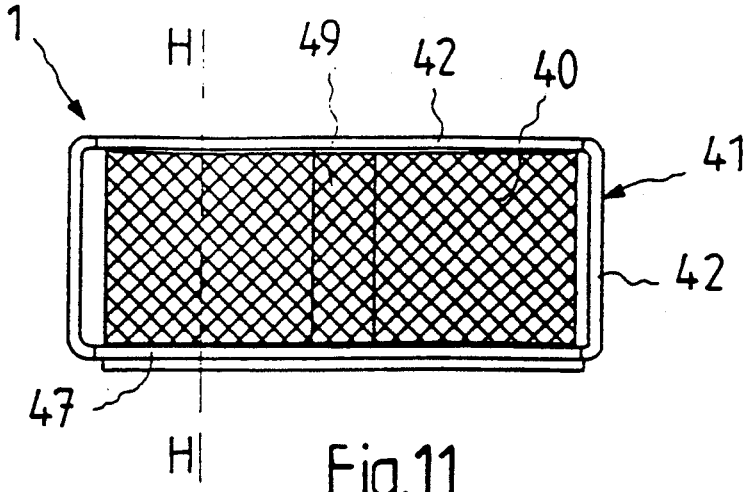
FIG. 11 illustrates another underlay seen from the top.

The bottom 40 of the underlay 1 can be made of many different materials, such as cloth or net. FIG. 11 illustrates an underlay 1, the bottom 40 whereof is made of net. The bottom is most advantageously made of some such material that can be left under the patient when the patient is put on the transport couch and taken for instance to the examination rooms of the hospital. Thus the shift from the transport couch back to the suport of the support frame 2 naturally becomes easier, because the underlay 1 is continuously under the patient.

The bottom 40 can be made for example of some waterproof material such as plastic. The bottom 40 is provided with an aperture 44, which is most advantageously placed in the middle region of the underlay. To this aperture 44, there can be connected a hose 45 for instance by means of a suitable bayonet catch 46. The hose 45 can be conducted from the aperture 44 of the underlay further to a sewer or other vessel where water can be collected. This type of underlay 1 is suitable to be used as a shower basin, where the patient can be conveniently washed.

Figure 12:
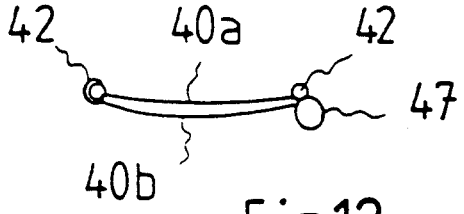
FIG. 12 illustrates a cross-section of the underlay of FIG. 11.

The bottom 40 of the underlay 1 can be made of two different parts, as is shown in FIG. 12. The first bottom part 40*a* is made of net or other such material, which is well permeable to air and water. The second part 40*b* is made of some waterproof material, such as plastic foil. The second part 40*b* is arranged on a roller 47 along the long side of the underlay 1, wherefrom it can be drawn to underneath the first part 40*a*. The second bottom part 40*b* can be attached, with suitable fastening means, to the frame 41 of the underlay 1. The second part **40*b* is used when the patient is washed for instance by means of a shower. When the second part 40*b* is not needed, it is rolled along the long side of the bed bottom 40. This second bottom part can naturally be provided with a corresponding aperture 44, whereto a hose can be fastened by means of a suitable catch, in similar fashion as was explained in connection with the underlay 1 of FIGS. 9 and 10**.

It is advantageous to provide the bottom 40 of the underlay 1 with an aperture 48 for a bedpan (marked with dotted lines in FIGS. 9 and 10). This aperture is adjusted on the bottom, in an area where the patient's buttocks rest when he is lying on the underlay 1. This aperture 48 is used for collecting the excretion, i.e. urine and excrement, of the patient. Accordingly, a bedpan is adjusted underneath this aperture, so that the patient can relieve himself. This arrangement means a remarkable help in treating chronic patients in hospitals, because now the nurse doe snot have to lift the patient manually out of bed and then adjust the bedpan, which is uncomfortable for the patient.

The aperture 48 for the bedpan can be arranged by means of a hatch 49, as is illustrated in FIG. 11. The hatch 49 is a stretch of the bottom 40, which can be turned aside from underneath the patient when the bedpan is needed.

Figure 13:
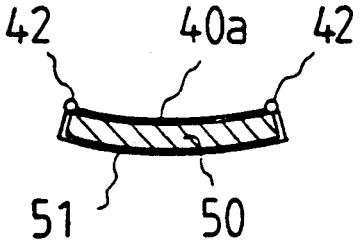
FIG. 13 illustrates a cross-section of an underlay which is provided with heat insulation.

The underlay 1 can be provided underneath with heat insulation, as is shown in FIG. 13. In this case the underlay 1 comprises a heat insulation layer 50, which in all essential length and width measures corresponds to those of the underlay 1. It is detachably fastened under the underlay 1 for instance by means of straps 51 or other suitable fastening means. The straps 51 are attached for example by means of clasps to the support railings 42 located on the long sides of the underlay 1, and are brought under the insulation layer and fastened to the other support railing 42 on the opposite side. The heat insulation layer 50 can be formed of a suitable heat insulating material known as such, for instance of felt, polyurethane or the like.

In the bed of the present invention, particularly in connection with the support frame thereof, there can be provided means for measuring the patient's weight. For example in between the bearing 12 of the vertical support member and the tubular member 10 in FIG. 4, there can be installed a power sensor 52 which measures compressive force. By means of this, the total weight of the support frame 2, the connected equipment plus the patient P can be measured. The signal obtained from the power sensor 52 is processed with some suitable processor 53, such as microprocessor, and the patient's weight is indicated for example in a digital display 54.

In the above specification the invention has been mainly explained with reference to a few preferred embodiments, but it is pointed out that the invention can be modified in many ways within the scope of the inventional idea defined in the appended patent claims.

We claim:

1. An apparatus secured to a vertical wall structure for supporting a patient comprising:

a support frame (2) having a vertically extending arm portion (**2*b*), a horizontally extending arm portion (2*a*) and a crossbar (4) mounted on said horizontally extending arm portion (2*a*), said vertically extending arm portion (2*b*) having a vertical axis, said horizontal arm portion (2*a*) having a free end, and said crossbar (4**) having a first end and a second end;

a transfer underlay (1) having support rails (42) interconnected to define a perimeter and a flexible bed bottom (40) attached to said support rails (42) around said perimeter;

means for suspending said transfer underlay (3) from said horizontally extending arm portion (**2*a*); and means for adjusting said support frame (2) connected to said vertical extending arm portion and to the vertical wall structure for lifting and lowering said support frame (2) and for rotating said support frame (2) about said axis of said vertically extending arm portion (2*b***).

2. The apparatus according to claim 1, wherein said means for suspending said transfer underlay (3) is attached to said first end of said crossbar (4), said second end of said crossbar (4) and to said free end of said horizontally extending arm portion (**2*a***) with two support points defining a line, for locating at least one of said support points outside the line defining the other two support points.

3. The apparatus according to claim 1, further comprising means for adjusting said transfer underlay toward and away from said horizontal arm portion (**2*a*), said means for adjusting being mounted on said support frame (2**).

4. The apparatus according to claim 1, wherein said horizontally extending arm portion (**2*a*) further comprises a horizontally slidable telescopic sleeve portion (6**) having a free end support point.

5. The apparatus according to claim 1, wherein said means for suspending said transfer underlay (3) is attached to said first end of said crossbar (4), said second end of said crossbar (4) and to said free end of said telescopic sleeve portion (6).

6. The apparatus according to claim 1, wherein said flexible bed bottom transfer underlay (1) further comprises:

support rails interconnected to define a perimeter;

a first bottom part (**40*a*) permeable to air and water and attached to said support rails about said perimeter; and a second waterproof bottom part (40*b*) for collecting wash water, said second waterproof part being detachably fastened underneath said first bottom part (40*a***).

7. The transfer underlay (1) according to claim 6, wherein said second bottom part (**40*b***) is movable from a first stored position to a second extended position.

8. The transfer underlay (1) according to claim 6, wherein said second bottom part (**40*b*) has a discharge aperture (44**) for discharging said wash water.

9. The transfer underlay (1) according to claim 6, wherein said transfer underlay is provided with an aperture (48) for a bedpan.

10. The transfer underlay (1) according to claim 6, further comprising a heat insulation layer (50) which is detachably fastened to said first bed bottom (**40*a***).

11. An apparatus mountable on a wall structure for supporting a patient, comprising:

a tubular coupling member (10) connectable to the wall structure along a vertical axis for allowing the apparatus to be attached to the wall structure, said tubular member having an upper end and a lower end and being detachable from the vertical wall structure;

a support frame (2) having a vertically extending arm portion (2*b*) having a vertical axis, a horizontally extending arm portion (2*a*) having a longitudinal axis and a crossbar, said horizontally extending arm portion (2*a*) having a free end, said crossbar (4) being mounted on said horizontally extending arm portion (2*a*) and having a first end and a second end, said support frame (2) being attached to said upper end of said tubular coupling member;

a bottom support carriage (2*c*) extending substantially longitudinally of the axis of the horizontally extending arm portion (2*a*), said support carriage (2*c*) having a distal end and a proximal end, said proximal end of said support carriage (2*c*) being attached to said lower end of said tubular coupling member, said tubular coupling member (10), said support frame (2), and said bottom support carriage (2*c*) being movable away from the wall structure as an unit.

12. The apparatus according to claim 11, wherein said horizontally extending arm portion (2*a*) further comprises a horizontally slidable telescopic sleeve portion (6) having a free end support point.

13. The apparatus according to claim 12, wherein said means for suspending said transfer underlay (3) is attached to said first end of said crossbar (4) said second end of said crossbar (4) and to said free end of said telescopic sleeve portion (6).

14. The apparatus according to claim 11, further comprising a transport couch (28) attachable to said tubular coupling member (10) for transporting the patient, said transport couch (28) positioned along said longitudinal axis of said horizontally extending arm portion (2*a*).

15. The apparatus according to claim 14, wherein said tubular coupling member (10) is detachable from the vertical wall structure, said tubular coupling member (10), said support frame (2), said bottom support carriage (2*c*), said transport couch (28) and said transfer underlay (1) being movable away from the wall structure as an unit.

16. The apparatus according to claim 15, wherein said transport couch (28) is detachable from said tubular coupling member (10).

17. The apparatus according to claim 11, further comprising means for adjusting said transfer underlay (8) toward and away from said horizontal arm portion (2*a*), said means for adjusting being mounted on said support frame (2).

18. The apparatus according the claim 11, wherein said vertical support member (2*a*) is rotatable about said vertical axis.

19. The apparatus according to claim 11, wherein said crossbar (4) is movable along said horizontal support member (2*a*) and lockable into a set position along said horizontal support member (2*a*).

20. The apparatus according to claim 11, further comprising means for adjusting said transfer underlay toward and away from said horizontal arm portion (2*a*), said means of adjusting being mounted at said first and second ends of said crossbar (4) and at said free end of said telescopic sleeve portion (6).

21. The apparatus according to claim 11 wherein said bed bottom (40) is a net material.

22. The apparatus according to claim 11, further comprising means for measuring the weight of the patient, said means for measuring being mounted on said vertical support member (2*b*).

* * * * *